US008578670B2

(12) United States Patent
Wu et al.

(10) Patent No.: US 8,578,670 B2
(45) Date of Patent: Nov. 12, 2013

(54) CONSTRUCTION STRUCTURE AND METHOD OF MAKING THEREOF

(75) Inventors: Yufei Wu, Kowloon (HK); Jian Lu, Kowloon (HK)

(73) Assignee: City University of Hong Kong, Hong Kong (CN)

( * ) Notice: Subject to any disclaimer, the term of this patent is extended or adjusted under 35 U.S.C. 154(b) by 173 days.

(21) Appl. No.: 13/176,305

(22) Filed: Jul. 5, 2011

(65) Prior Publication Data

US 2013/0008120 A1 Jan. 10, 2013

(51) Int. Cl.
*E04C 5/12* (2006.01)

(52) U.S. Cl.
USPC ..... 52/223.6; 52/231; 52/291; 52/514; 75/10.11

(58) Field of Classification Search
USPC ..... 52/223.1, 223.4, 223.6, 231, 291, 514; 75/10.11
See application file for complete search history.

(56) References Cited

U.S. PATENT DOCUMENTS

| | | | | |
|---|---|---|---|---|
| 3,982,362 | A * | 9/1976 | Moore | 52/91.2 |
| 6,802,163 | B2 * | 10/2004 | Hackman et al. | 52/311.1 |
| 2004/0093816 | A1 * | 5/2004 | Smythe, Jr. | 52/255 |
| 2006/0059809 | A1 * | 3/2006 | Smythe, Jr. | 52/255 |
| 2006/0112652 | A1 * | 6/2006 | Ichikawa et al. | 52/167.1 |
| 2007/0022688 | A1 * | 2/2007 | Fisher | 52/364 |
| 2009/0071085 | A1 * | 3/2009 | Wheatley et al. | 52/291 |
| 2010/0071285 | A1 * | 3/2010 | Richard et al. | 52/192 |
| 2010/0111747 | A1 * | 5/2010 | Branagan et al. | 420/10 |
| 2012/0174509 | A1 * | 7/2012 | Dhinjan | 52/255 |

OTHER PUBLICATIONS

Ke Lu et al., "Surface Nanocrystallization (SNC) of Metallic Materials-Presentation of the Concept Behind a New Approach", J. Mater. Sci. Technol. vol. 15(3) 1999.
W.P. Tong et al., "Nitriding Ironi at Lower Temperatures", Science, Jan. 31, 2003, vol. 299.

* cited by examiner

*Primary Examiner* — William Gilbert
*Assistant Examiner* — Alp Akbasli
(74) *Attorney, Agent, or Firm* — Heslin Rothenberg Farley & Mesiti P.C.

(57) ABSTRACT

A construction structure includes a substrate made of a concrete material and has an external surface, and a reinforcement attachment made of a metallic material having an outwardly facing surface and an inwardly facing surface. The attachment is secured to the substrate with the inwardly facing surface bonded to the external surface of the substrate, and has first portions and second portions. At least one of the surfaces of a first portion of the attachment is pre-treated and attached to the substrate such that when the construction structure is under loading the first portion(s) block(s) or reduce(s) spreading of strain sustained by the attachment along the attachment to avoid or at least delay complete detachment of reinforcement from substrate.

8 Claims, 19 Drawing Sheets

SP9

SP10

SP11

SP12

CONSTRUCTION STRUCTURE AND METHOD OF MAKING THEREOF

CROSS REFERENCE TO RELATED APPLICATION

The present invention relates to U.S. Ser. No. 13/176,278, entitled "Construction Structure and Method of Making Thereof", filed on Jul. 5, 2011 the entire disclosure of which is incorporated herein by reference.

FIELD OF THE INVENTION

The present invention is concerned with a construction structure, and in particular a construction structure with a reinforcement attachment. The present invention is also concerned with a method of building such structure, and a method of localization of strain sustained by such attachment.

BACKGROUND OF THE INVENTION

Rehabilitation such as repairing, strengthening, retrofitting of structures is one of the major structural engineering tasks in developed countries. It is estimated that such rehabilitation accounts for more than 50% of total spending in the construction industry. This is a problem that is becoming increasingly imminent in developing countries due to aging, poor design or inadequate maintenance of construction structures.

The use of externally-bonded or—attached high strength reinforcement to reinforce a substrate concrete is currently the most popular method for structural rehabilitation, largely due to its ease of handling in construction. Because of the high strength of the reinforcement material, the material may be made relatively thin. As a result, normal mechanical anchors cannot be directly used for bonding the reinforcement onto the substrate concrete. In order to address this problem, the reinforcement is usually attached to the concrete substrate by surface adhesion. However, the adhesive bond between the reinforcement and the substrate concrete is usually relatively weak such that failure is typically caused by breakdown of the bond at the adhesive interface, i.e. debonding failure. Consequently, tensile strength of high strength reinforcing materials cannot be fully realized unless only a small scale of reinforcement is needed. For larger size of construction structures or when a high increase in structure member strength is required, this technology is often ineffective in providing sufficient strength.

Various technologies have been reported with a view to overcome the problem of debonding of a reinforcement member from a core member of a construction structure. A system called the hybrid-bonded system has been proposed to significantly increase the bonding strength of a reinforcement member with a core substrate. However, the increase in bonding strength usually comes with a significant increase in construction time, cost and labor.

The present invention seeks to provide an improved reinforcement system for use in construction structures, or at least to provide an alternative to the public.

SUMMARY OF THE INVENTION

According to a first aspect of the present invention, there is provided a construction structure comprising a substrate made of a concrete material and providing an external surface, and a reinforcement attachment or jacket made of a metallic material and defining an outwardly facing surface and an inwardly facing surface, wherein the attachment is secured to the substrate with the inwardly facing surface bonded to the external surface of the substrate, the attachment having at least a first portion and a second portion, one or both of the surfaces of the attachment are pre-treated such that yield strength of the first portion is higher than yield strength of the second portion and yielding or larger strain of the reinforcement attachment is localized to the second portion under longitudinal stress, whereby when the construction structure is under stress the first portion(s) block(s) or reduce(s) spreading of longitudinal strain sustained by the reinforcement along the attachment. With this configuration, the construction structure is better constructed in that complete debonding of the attachment can be avoided or at least delayed. In the context of this description, the term "concrete" has a broad meaning and refers to material made of cement and other aggregates, bricks or masonry.

Preferably, the surfaces of the attachment may be divided into a first zone and a second zone corresponding to the first portion(s) and the second portion(s) of the attachment, the first zone may be pre-treated with surface nanocrystallization and the second zone may either be not pre-treated with nanocrystallization or pre-treated with less surface nanocrystallization when compared with the first zone whereby when the construction structure is subject to longitudinal stress larger strain is confined between adjacent first portion(s) of the attachment.

In a preferred embodiment, the first portions and the second portions may be alternatively arranged.

In an embodiment, the attachment may be made from a metallic material selected from the group including iron, titanium, copper aluminum alloy and steel.

Suitably, the attachment may be substantially planar or configured to wrap around the substrate.

In one embodiment, the attachment may be adhesively bonded to the substrate. The attachment may be secured to the substrate by further connection means selected from a group including mechanical fasteners, fiber anchorage fasteners and U-jacketing fasteners.

The structure may take the form of a beam or a pillar.

According to a second aspect of the present invention, there is provided a method of building a reinforced construction structure, comprising the steps of: (a) providing a substrate made of a concrete material, (b) preparing a reinforcement attachment made of a metallic material having a first surface for engagement with the substrate and a second surface on opposite side thereof, (c) identifying and dividing the attachment into at least a first portion and a second portion, (d) treating the attachment with surface nanocrystallization such that one or both of the surfaces of the first portion(s) are nanocrystallized and the surfaces of the second portion(s) are either not nanocrystallized or the surfaces of the of the first portion(s) possess(es) a greater degree of surface nanocrystallization than the surfaces of the second portion(s) whereby the surfaces are zoned with different degree or extent of nanocrystallization, and (d) securing the attachment to the substrate whereby when the construction structure is under stress the first portion(s) block(s) or reduce(s) spreading of strain along the attachment.

According to a third aspect of the present invention, there is provided a method of avoiding or delaying complete detachment of a reinforcing attachment from a substrate of a construction structure, comprising the steps of: (a) preparing a reinforcement attachment made of a metallic material having a first surface for engagement with a substrate and a second surface on opposite side thereof, (b) dividing the surfaces of the attachment into a first zone and a second zone, (c) treating the attachment with surface nanocrystallization such that the first zone is nanocrystallized and the second zone is either not nanocrystallized or the first zone possesses a greater degree of surface nanocrystallization than the second zone whereby the attachment is zoned with different degrees or extent of nanocrystallization, and (d) securing the attachment to the substrate whereby when the construction structure is under stress the first zone blocks or reduces spreading of strain sustained by the attachment along the attachment.

Preferably, the first zone and the second zone may be alternatively arranged whereby adjacent first portions reduce spreading of strain along and sustained by the attachment.

According to a fourth aspect of the present invention, there is provided a construction structure comprising a substrate made of a concrete material and providing an external surface, and an external reinforcement attachment and defining an outwardly facing surface and an inwardly facing surface and with a non-uniform cross-sectional area along the reinforcement attachment, wherein the reinforcement attachment is secured to the substrate with the inwardly facing surface bonded to the external surface of the substrate, the reinforcement attachment having at least a first portion and a second portion, the attachment is treated such that the first portion(s) has/have a greater cross-sectional area than the second portion(s) for increasing yield strength of the first portion(s) whereby when the construction structure is under loading the first portion(s) block(s) or reduce(s) spreading of strain sustained by the reinforcement attachment.

According to a fifth aspect of the invention, there is provided a method of building a reinforced construction structure, comprising the steps of (a) providing a substrate made of a concrete material, (b) preparing an external reinforcement attachment made of a material having a first surface for engagement with the substrate and a second surface on opposite side thereof, (c) identifying and dividing the attachment into at least a first portion and a second portions, (d) treating the reinforcement attachment such that a variation of cross-sectional area of the attachment is introduced along its length, whereby the first portion(s) has/have a higher yield strength than the second portion(s), and (e) securing the reinforcement attachment to the substrate whereby when the construction structure is under loading the first portion(s) sustaining lower strain and the second portion(s) sustaining higher strain.

According to a sixth aspect of the present invention, there is provided a method of avoiding or delaying complete detachment of a reinforcement attachment from a substrate of a construction structure, comprising the steps of: (a) preparing an external reinforcement attachment made of a material having a first surface for engagement with a substrate and a second surface on opposite side thereof, (b) dividing the reinforcement attachment into a first zone and a second zone, (c) treating the reinforcement attachment such that a variation of cross-sectional area of the reinforcement attachment is introduced along its length, whereby the first zone has a higher yield strength than the second zone, and (d) securing the reinforcement attachment to the substrate whereby when the construction structure is under loading the first zone sustaining lower strain and the second zone sustaining higher strain.

BRIEF DESCRIPTION OF THE DRAWINGS

Some embodiments of the present invention will now be described by way of example and with reference to the accompanying drawings, in which.

DETAILED DESCRIPTION OF THE PRESENT INVENTION

Figure 1A:
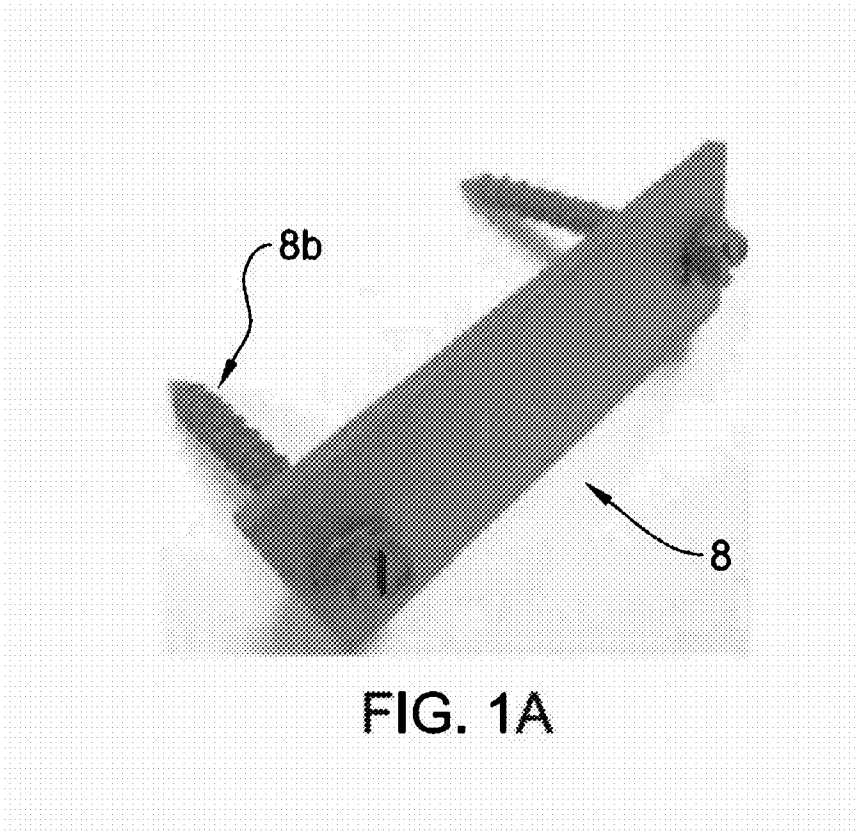
FIGS. 1A to 1D include photographic and schematic representations showing a hybrid-bonded FRP reinforcement system.
Figures 1B, 1C:
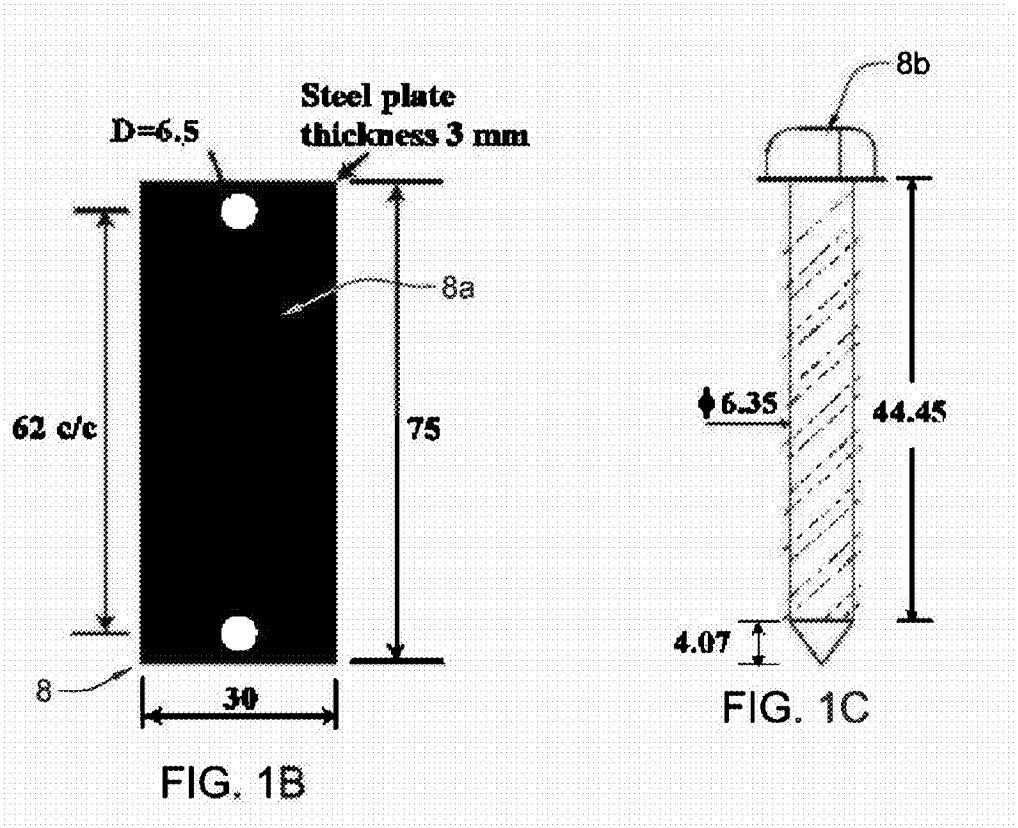
Figure 1D:
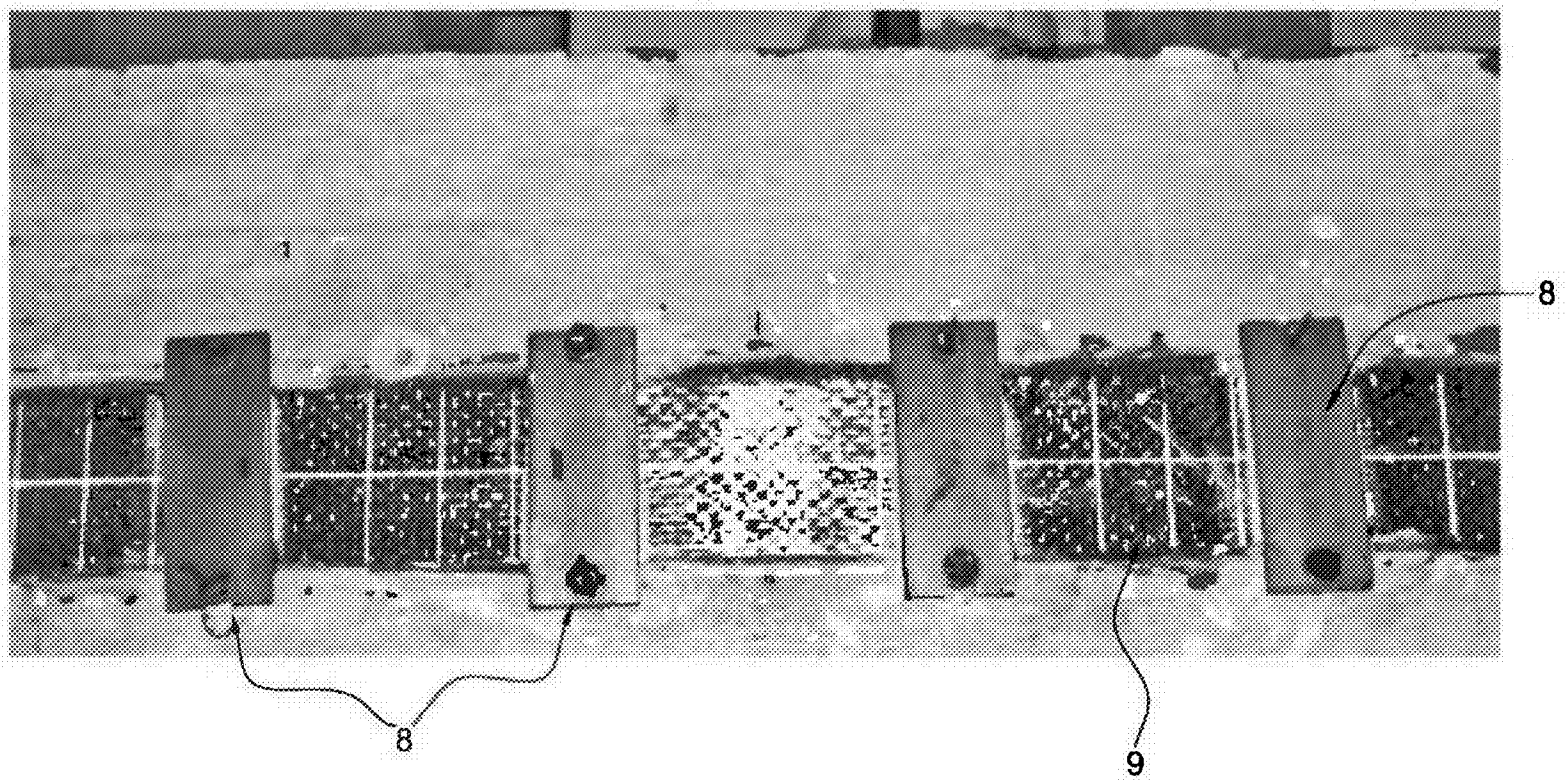

Recent developments in materials science and technology have lead to very high strength thin steel sheets that are not only very strong but also ductile. Compared with relatively brittle materials such as fiber reinforced polymer (FRP) and steel-fiber reinforced polymer (SRP) and heavy steel plates, this kind of strong and yet ductile steel sheets could be more suitable for structural rehabilitation. One way to make strong steel sheets is to nanocrystallize the surface of normal steel sheet/plate. The nanostructured steel plate may provide a stronger reinforcement attachment and thus a stronger reinforced concrete (RC) beams. Such nanostructured steel plate, when appropriately designed and used, may to some extent mitigate the problem of debonding.

Various systems have been used to minimize debonding of reinforcement members or attachments from concrete structures. These systems can be classified into three categories, namely 1) mechanical fastening, 2) surface adhesion, and 3) near surface mounting. Mechanical fastening is suitable for bonding thick and non-brittle reinforcement materials such as steel plates and SafStrip™ (a special thick and ductile FRP strip suitable for short-term strengthening of structures). Mechanical fastening can be an effective and reliable method and has been used in the construction industry under certain circumstances. However, due to heavy weight and construction inconvenience, steel plate as externally-bonded reinforcement has been replaced in recent years by the more advanced material FRP that has the advantage of lightweight, high strength and ease of handling in construction. Nevertheless, conventional mechanical anchors or bolts usually cannot be used directly for mounting thin and non-ductile external reinforcement materials such as FRP, SRP and thin steel sheets, which do not have sufficient bearing strength to avoid longitudinal cutting by the anchors. Therefore, the current practice in the construction industry is to use adhesive for bonding thin and/or brittle reinforcement materials onto the concrete member.

In adhesively-bonded systems, debonding is a critical problem that cannot be resolved by merely using a stronger adhesive. This is because debonding typically occurs inside concrete, meaning a thin layer of concrete skin is peeled off from the concrete member when adhesives with adequate strength are used. Therefore, the bond strength is determined by concrete tensile strength, which cannot be changed after the concrete structure is made. The tensile strength of concrete is not only low but also unstable and even unreliable in long term, particularly on the surface of concrete structures. Therefore, externally-bonded reinforcement systems that rely on surface adhesion are not only weak but also unreliable.

To address the problem of debonding of surface bonded reinforcement, various bond enhancement methods or fastening means can be used, these include end anchorages, fiber anchors (or anchor spikes), and U-jacketing methods. End anchorages with large mechanical fasteners are effective for restraining debonding initiated at two (opposite) ends of the reinforcement strip or for preventing complete detachment of the reinforcement from the concrete substrate. However, it cannot effectively block the development of debonding elsewhere and hence is usually ineffective for intermediate cracks induced debonding (IC-debonding) where debonding initiates near the maximum moment region. In a fiber anchoring system, fiber anchors made from bundles of fibers are inserted into epoxy-filled holes in the concrete substrate. The free ends of the fibers are then splayed and bonded onto the surface of the reinforcing laminate with adhesive. Studies have shown that a single anchor increased bonding strength by 73% and the second anchor behind the first one increased bonding strength further by 86%. However, studies show that this increase falls to 0% when the distance between the two anchors increases from 75 mm to 125 mm, apparently caused by successive shearing off of the anchors due to brittleness of the FRP anchor. U-jacketing is a popular and extensively investigated bonding enhancement method in which many U-shaped FRP or steel strips are used to wrap the longitudinal reinforcing strip along the span. Studies have shown that the bond strength can be increased by about 30%.

Near-surface mounting embeds the reinforcement into the groove cut into the cover concrete layer. This technology can significantly improve bonding condition and hence the bond strength. However, it is possible that the existing reinforcement bars—especially the transverse bars—may be cut during the groove making process. This technical difficulty has significantly hindered the application of this technology in practice.

In view of the deficiencies (e.g. debonding, sudden rupture, etc.) of various technologies which may be used, research, development and testing have been conducted leading to the present invention. The present invention makes use of a platform of hybrid bonded system and improves the bonding behavior of a reinforcement member with an underlying concrete core, to be explained and illustrated as followed.

Hybrid-bonded system utilizes both adhesive bond and mechanical fasteners that induce high passive frictional resistance similar to frictional bolt connections. The bond strength in a hybrid-bonded system can be increased more than 600%, which is sufficient to cause the breaking of 7-plies of FRP laminate. Due to the much increased bond resistance, IC-debonding is usually no longer a problem in the hybrid-bonded system which makes failure occur in other modes, such as FRP rupture in FRP strengthened beams. Although hybrid bonded technology can resolve the debonding problem, it would change the failure mode to another one—FRP rupture—that is as sudden, catastrophic and highly dangerous as debonding failure in a strengthened structural system. This is caused by the brittleness of FRP materials. Therefore, a material that possesses both the advantage of high-strength and light-weight of FRP and the advantage of ductility of steel would be ideal for structural rehabilitation. In one embodiment of the present invention, the relatively high-strength and light-weight material that is used is a nanostructured (NS) metallic member or sheet which serves as a reinforcement attachment for an underlying concrete core.

FIGS. 1A-1D show a hybrid-bonded FRP strengthening system which makes use of mechanical fasteners 8 (steel cover plates 8*a* of 3 mm in thickness, and self tapping concrete screws 8*b*). The mechanical fasteners 8 further strengthen attachment of the FRP strips 9 on the concrete core.

Surface Nanocrystallization Technology

Figure 2A:
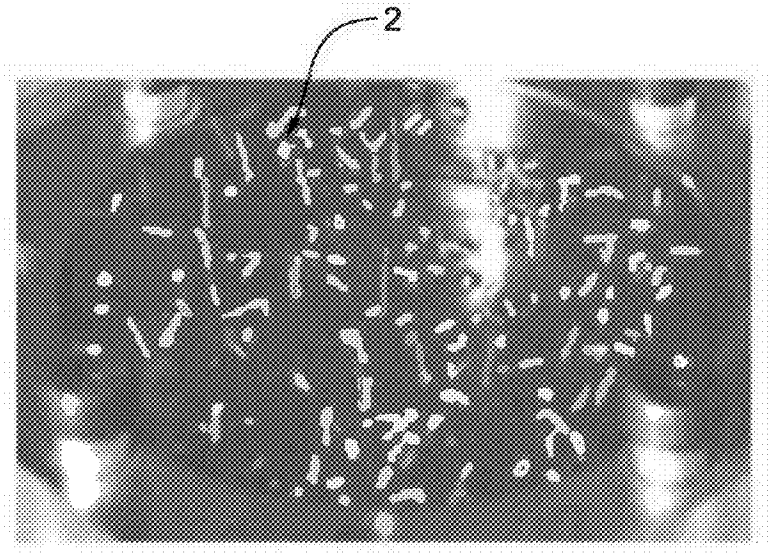
FIGS. 2A to 2C include photographic representations showing a reinforcement steel plate member with surface having undergone nanocrystallization and a chart showing the relationship of true stress and true strain sustained by the reinforcement member.
Figure 2B:
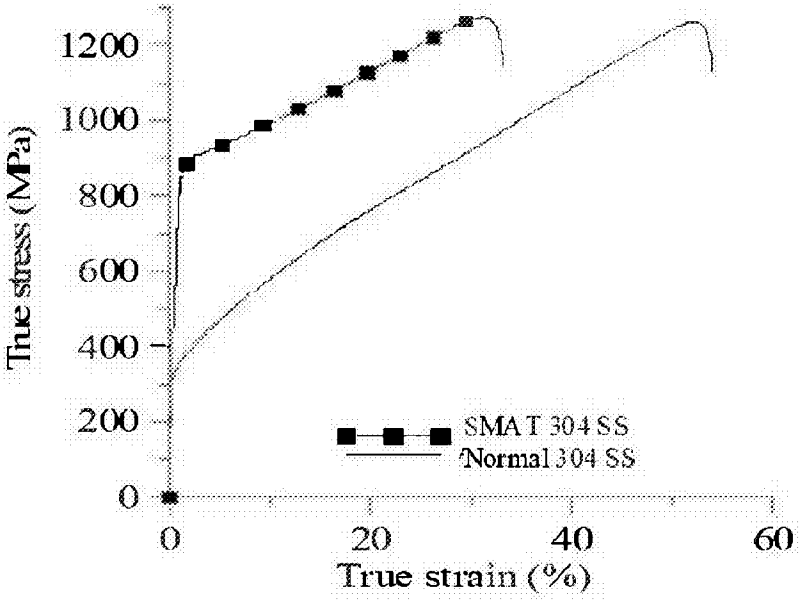
Figure 2C:
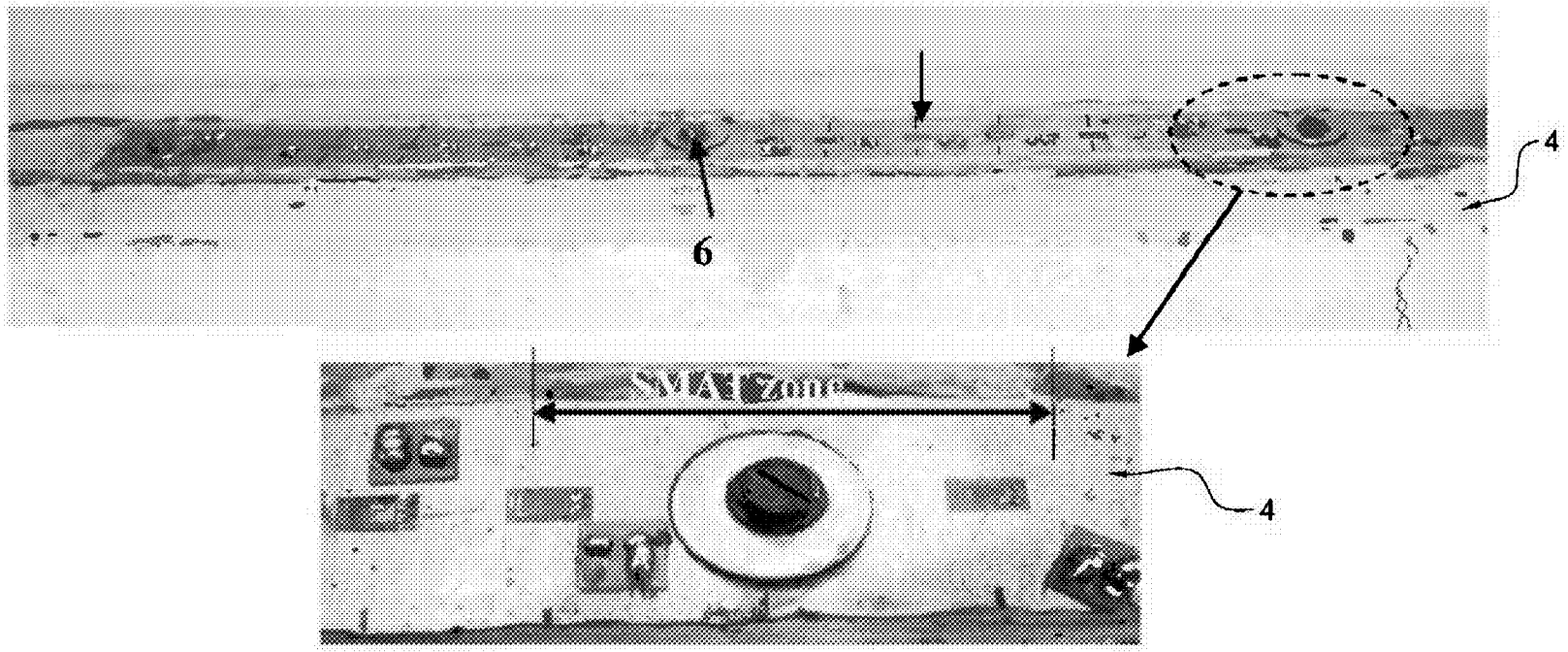

NS materials exhibit superior strength over their coarse-grained counterparts. One of the processes which may be used in forming nanocrystallized surface layer on a reinforcement attachment is by using Surface Mechanical Attrition Treatment (or Treated) (SMAT). This is achieved by actuating a number of spherical projectiles 2 to impact the material surface of, for example the reinforcement attachment 4 (e.g. steel plate). Please see FIGS. 2A and 2C. The two photographs in FIG. 2C show different views of a reinforced core member in that a reinforcement attachment is provided with a concrete also being used. Through the surface mechanical attrition treatment that generates repetitive severe plastic deformation of the surface layer, the microstructure of the subsurface layer of a material can be refined to nanoscale. This technology can be applied to a number of materials, such as iron, titanium, copper, aluminum alloy and stainless steel, for producing NS materials. NS materials possess fundamentally different and improved physical, chemical and mechanical properties and have behaviors different from their conventional coarse-grained polycrystalline counterparts. A typical stress-strain curve of a SMAT 304 stainless steel (SS) is shown in FIG. 2B. It is shown that under the same stress or pressure, NS materials sustain a lower strain or yielding. Studies have shown that SMAT materials possess superior strength as well as ductility.

To take advantage of NS reinforcement attachments, two strengthening schemes are designed for flexural strengthening (to avoid debonding) as well as for a ductile strengthening system, and are explained as follows.

Hybrid-Bonded (HB) System

The hybrid-bonded steel plating system in FIG. 2C seeks to make use of the same mechanism as the HB-FRP system, i.e. adhesion plus frictional bond, to produce sufficient bonding and to avoid debonding. As steel plate is ductile, the additional cover plates 8 as shown the HB-FRP system of FIGS. 1A-1D are not required in that concrete screws can be fastened directly on top of the steel plate. Since the concrete screws are mainly designed to provide passive compressive pressure to induce frictional bond, and not for longitudinal bearing resistance between the steel plate and the screws, the low longitudinal cut-in resistance of thin steel plate is not a problem. The main difference between the hybrid-bonded steel plating system and the normal mechanically-fastened steel plating system is the thickness of the steel plate, as well as the smoothness of the interface. In normal steel plating system, the longitudinal shear resistance at the interface relies on the bearing resistance between the steel plate and the anchor bolts, while hybrid-bonded systems rely on frictional bond. Good adhesive bond is necessary in HB systems; debonding must be inside concrete to produce a rough slipping plane and hence high frictional resistance.

Strain Localization Bonding System

Figure 3A:
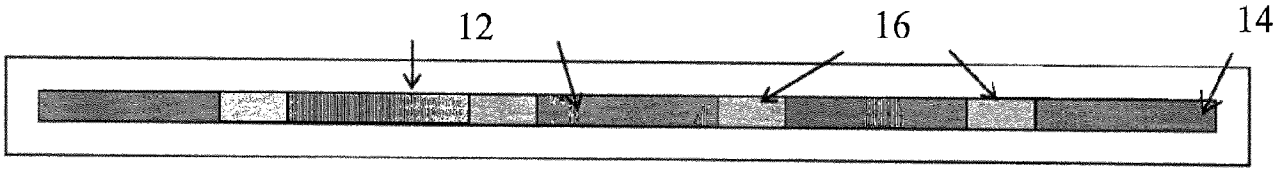
FIGS. 3A to 3D include schematic drawings and a graph illustrating localization of strain by making use of zoned nanocrystallization according to an embodiment of a reinforcement member of the present invention.
Figure 3B:
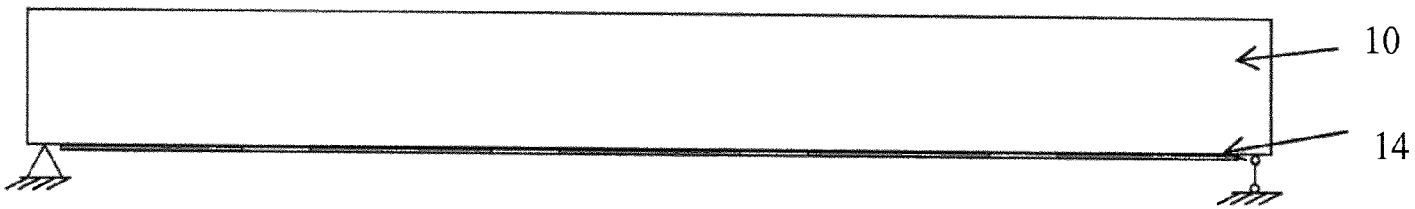
Figure 3C:
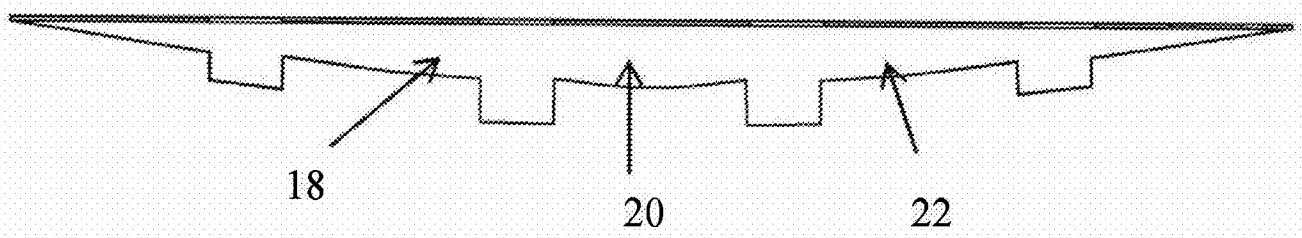
Figure 3D:
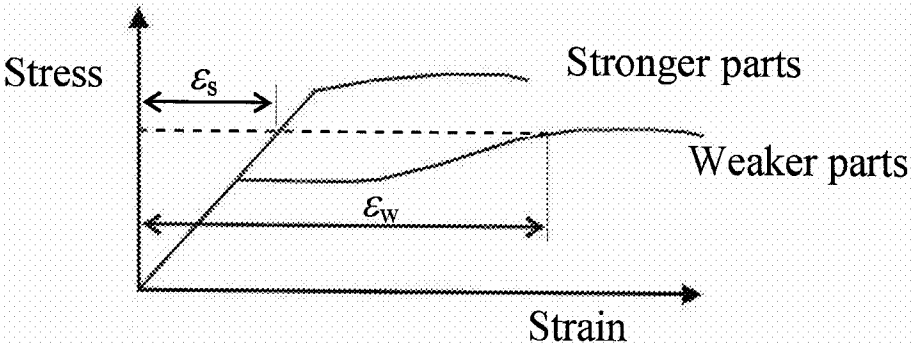

The present invention was arrived at by taking advantage of variations in yield strength of the SMAT material longitudinally. Embodiments of different reinforcement or plating systems according to the present invention have been developed in order to avoid, reduce or minimize debonding of the reinforcement attachments from substrate concrete, but without necessarily using other bond enhancement mechanisms such as mechanical fastening. The mechanism of the strain localization bonding system is illustrated in FIGS. 3A-3D. FIG. 3A shows a bottom view of a beam 10. FIG. 3B shows a side view of the beam 10. The darker areas (or zones) 12 of a reinforcement steel plate 14 indicate a heavier SMAT that results in higher yield strength of the material 14 and the lighter areas 16 have less or no SMAT, implying lower yield strength of the steel material 16. By varying the yield strength (across different portions) of the steel plate 14 in this way, the strain or yielding in the steel plate 14 will vary such that strain $\epsilon_s$ in darker areas 12 will be much smaller than strain $\epsilon_w$ in the lighter areas 16 after yielding of the steel plate 14, as illustrated in FIGS. 3C and 3D. FIG. 3D shows strain difference at same stress in plate.

In this plating system, strain increase is localized in lighter areas after the steel plate yields and it does not spread into darker areas after further increase in displacement of the beam because the steel material remains elastic in darker areas. As debonding is closely related to the strain of the external reinforcement and would not occur if the strain is controlled within certain limits, this strengthening system is potentially debonding-proof, without any additional bond enhancement.

The darker areas actually act as strain barriers that prevent spreading of yielding, and hence large strain in lighter areas into adjacent regions. The lighter parts contain large tension strain caused by deformation demand on the external reinforcement under large displacement. Therefore, even large displacements do not cause debonding in this system, until rupture of the steel plate.

It can be understood that the strain, or the higher strain or yielding, is localized in a weaker section of the reinforcement plate or between stronger sections of the reinforcement plate. In other words, reinforcement plate 14 allows larger strain be confined between two adjacent nanocrystallized portions (18, 20, or 20, 22) of the plate 14.

Results of experimental tests conducted to substantiate this expectation are illustrated later in this description.

The above strain localization principle can also be applied to other externally-bonded strengthening systems, such as for strengthening systems using normal steel plates. By cutting the reinforcement attachments thinner in some areas, the strain localization mechanism can also be realized in normal attachments such as normal steel plates. It is envisaged that in other embodiments, instead of using SMAT reinforcement attachments, reinforcement attachments made of for example FRP may be used.

Experimental testing was conducted to assess the effectiveness of the above two envisaged structural schemes. A total of 12 different specimen beams were made, strengthened and tested in the test program. Details of the tests are reported below.

Details of all specimens are summarized in Table 1 below.

TABLE 1

| Test specimens | | | | | | | | |
|---|---|---|---|---|---|---|---|---|
| | | | | Concrete | Test results | | | Sand- |
| Group no. | Specimen ID | Material type | Steel plate Treatment | strength (MPa) | Ultimate strength (kN) | Ultimate displ. (mm) | Failure mode | blasting type |
| 1 | SP1 | Mild | — | 42.16 | 19.6 | 79.9 | Debond | Fine |
| | SP2 | Stainless | SMAT | 41.74 | 20.5 | 28.0 | Debond | sand |
| | SP3 | Stainless | SMAT | 41.42 | 22.3 | 22.9 | Debond | |
| | SP4 | Stainless | SMAT | 40.40 | 25 | 138.5 | Test stop | |
| 2 | SP5 | Mild | — | 43.23 | 18.6 | 86.90 | Debond | |
| | SP6 | Mild | SMAT | 43.75 | 19 | 129.0 | Plate rupture | |
| | SP7 | Stainless | SMAT | 40.48 | 20.8 | 23.4 | Plate rupture | |
| 3 | SP8 | Mild | — | 44.47 | 37.3 | 38.46 | Debond | Coarse |
| | SP9 | Mild | 1 thin zone | 44.87 | 31 | 44.46 | Plate rupture | sand |
| | SP10 | Mild | 3 thin zones | 45.56 | 32.6 | 38.76 | Plate rupture | |
| | SP11 | Mild | 5 thin zones | 41.74 | 30.8 | 43.64 | Plate rupture | |
| | SP12 | Mild | 7 thin zones | 41.78 | 31.2 | 91 | Plate rupture | |

Figure 4A:
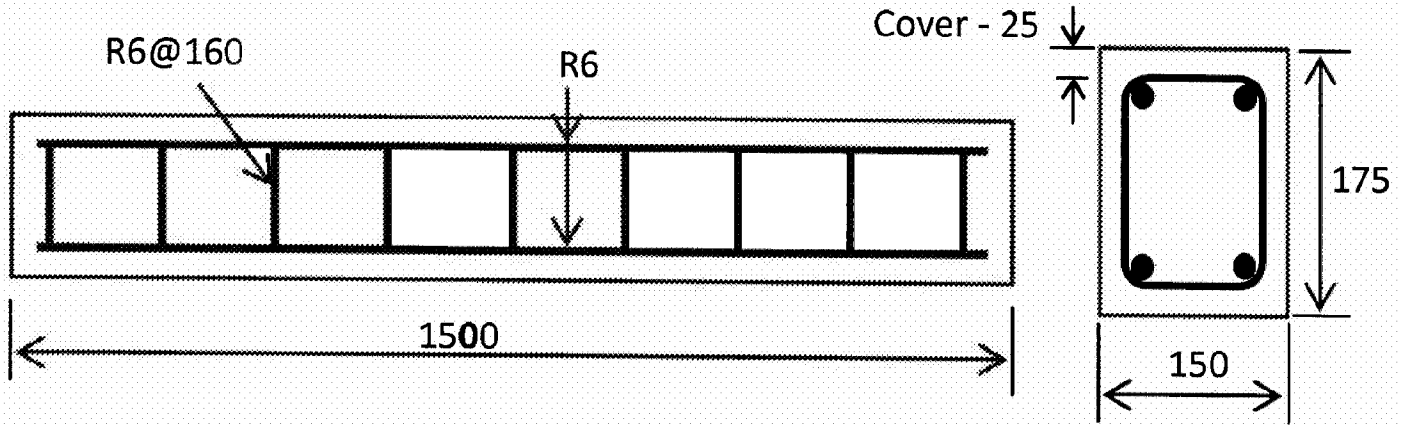
FIG. 4A depicts schematic diagrams showing different test specimens of reinforcement members.
Figure 4B:
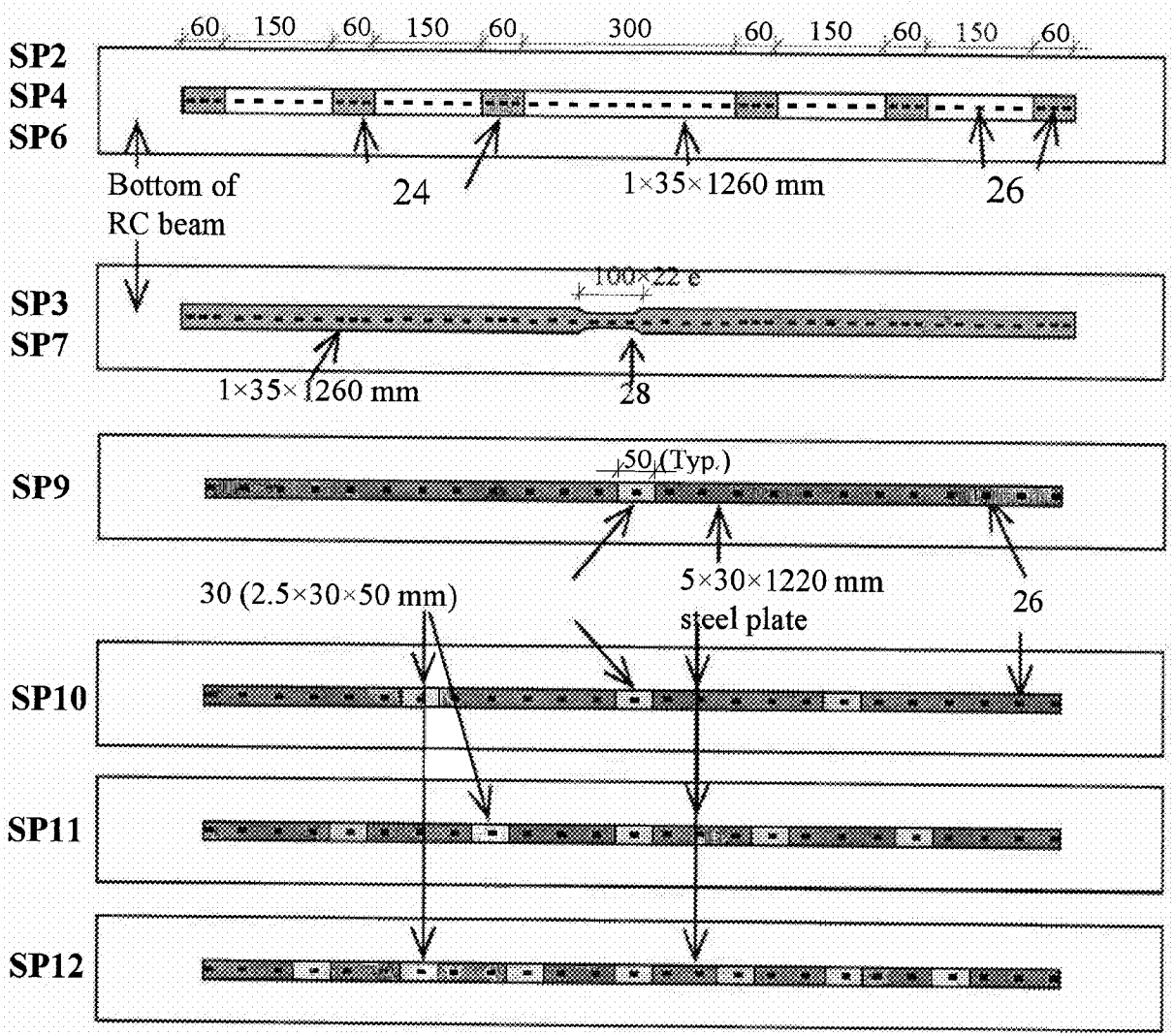
FIG. 4B depicts steel sheets and plates used for strengthening.

Some of the details of the specimen RC beams (e.g. dimensions, zoning of SMAT regions, etc.), are shown in FIG. 4A. The steel sheets and plates used for strengthening are shown in FIG. 4B. Material properties of the steel bar, steel sheet and steel plate are provided in Table 2 below. Otherwise, the right hand side diagram of FIG. 4A shows a schematic cross section of a beam.

TABLE 2

| Material properties | | | |
|---|---|---|---|
| Material | Yield strength (MPa) | Ultimate strength (MPa) | Young's Modulus (GPa) |
| R6 steel bar | 368 | 491 | 207 |
| 1 mm mild steel plate | 223 | 343 | 194 |
| 1 mm SMAT mild steel plate | 330 | 353 | 190 |
| 1 mm stainless steel plate | 250 | 671 | 197 |
| 1 mm SMAT stainless steel plate | 770 | 863 | 203 |
| 5 mm mild steel plate | 316 | 447 | 216 |

All steel sheets/plates were bonded with surface adhesion only, apart from specimen SP4. Preparation of substrate concrete and the adhesive bonding process for steel sheet/plate followed the normal procedure. Details of the concrete screw used for hybrid bonding of specimen SP4 are given in FIGS. 1A-1D. The bond face of steel sheets/plates was roughened by sandblasting. Two types of sands were used for sand blasting: fine quarts sand (size 0.5-0.7 mm) and coarse corundum power sand (size 1.5-2.0 mm). The pressure for sandblasting was 8 bar. Group 1 members were sandblasted with fine sand and the other two groups were treated with coarse sand, as indicated in Table 1.

Further details of the specimens as shown in FIGS. 4A and 4B are described as follows.

SP2, SP4 and SP6: The SMAT zones are shown in darker areas 24. The steel sheets have a dimension of 1×35×

1260 mm and strain gauges are placed at various locations 26 as indicated by black dots.

SP3 and SP7: The fully SMAT steel sheets have a dimension of 1×35×1260 mm, and have a narrower zone 28 with a dimension of 100×22 mm.

SP9: The steel plate has a dimension of 5×30×1220 mm and has a thinner zone 30 of 2.5×30×50 mm.

SP10, SP11 and SP12: The steel plates also have a dimension of 5×30×1220 mm, and been provided with different number of thinner zones 30.

Test Setup and Results

Figure 5:
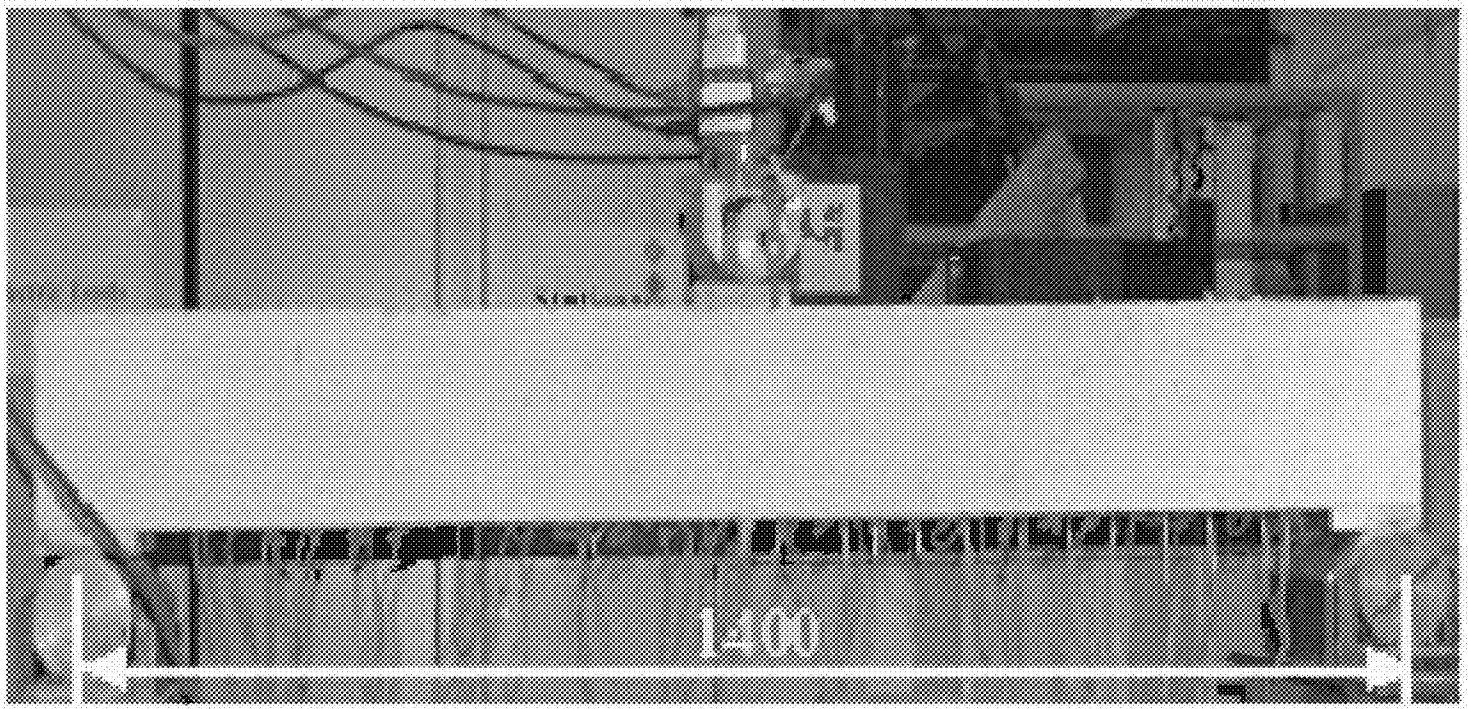
FIG. 5 is a photographic representation showing a test setup for use in testing performance of the reinforcement members of in FIGS. 4A and 4B.

The beams were tested under three points bending. The test setup is shown in FIG. 5. Test instrumentation included the load cell that measured the total applied load and the linear variable differential transformer LVDT that measured displacement at the bottom of the mid-span. Strain gauges were mounted on the surface of the steel sheet/plate. Locations of strain gauges are indicated in FIG. 4B. Testing was conducted under a displacement control mode.

Figure 6:
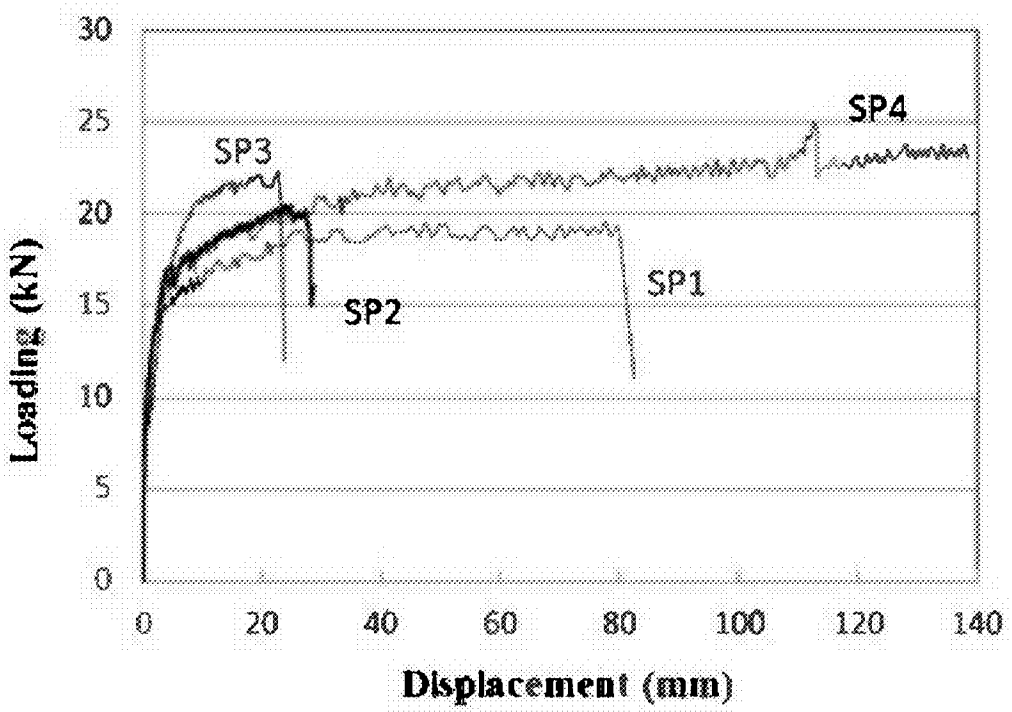
FIG. 6 is a graph showing the relationship of displacement and loading or yielding sustained by some of the test specimens in FIGS. 4A and 4B.

The typical load displacement curves for specimens SP1, 2, 3 and 4 are shown in FIG. 6. The failure mode, ultimate load and displacement for all specimens are given in Table 1. Apart from SP4, other specimens either failed in debonding or because of steel plate rupture. SP4 did not fail in debonding or steel plate rupture; the test was stopped in the end due to the travel limit of the instrumentation.

Discussion of Test Results

Group 1 Members (SP1 to SP4)

The bond surface of the steel sheet for this group of members was sandblasted with fine sand. The surface was quite smooth after sandblasting. Therefore, the bond between the steel sheet and the substrate concrete was relatively poor compared with Group 2 members. As a result, all members apart from SP4 failed due to debonding. SP4 was hybrid-bonded with one concrete screw at the center of every SMAT zone (FIG. 2C). Due to significant enhancement in bonding strength by hybrid-bonding, SP4 did not debond up to the travel limit of the LVDT.

The tests in this group demonstrated that if the adhesive bond is weak, neither of strain localization schemes in FIG. 4B could prevent the spread of debonding. However, hybrid-bonding (e.g. with the assistance of concrete screw) could effectively prevent debonding from spreading to the entire bonded side, even with weak adhesive bond. This test again demonstrates the high effectiveness of the hybrid bonded reinforcing system.

Group 2 Members (SP5 to SP7)

In this group a much rougher surface of steel sheet/plate was produced for bonding, by use of coarse corundum sand for sandblasting. Therefore, adhesive strength of the bond at the interface was much improved for members of Groups 2 and 3. As a result, the steel plate ruptured in specimen SP7, where the SMAT steel sheet for SP3 was recycled. SP5 was a reference (control) beam without strain localization mechanism; the beam failed in debonding at the end of the tests. SP6 with local SMAT failed in rupture of the steel sheet at a very large displacement of 129 mm. Therefore, both types of strain localization mechanisms successfully prevented debonding failure of the reinforcement steel attachments.

Figure 7:
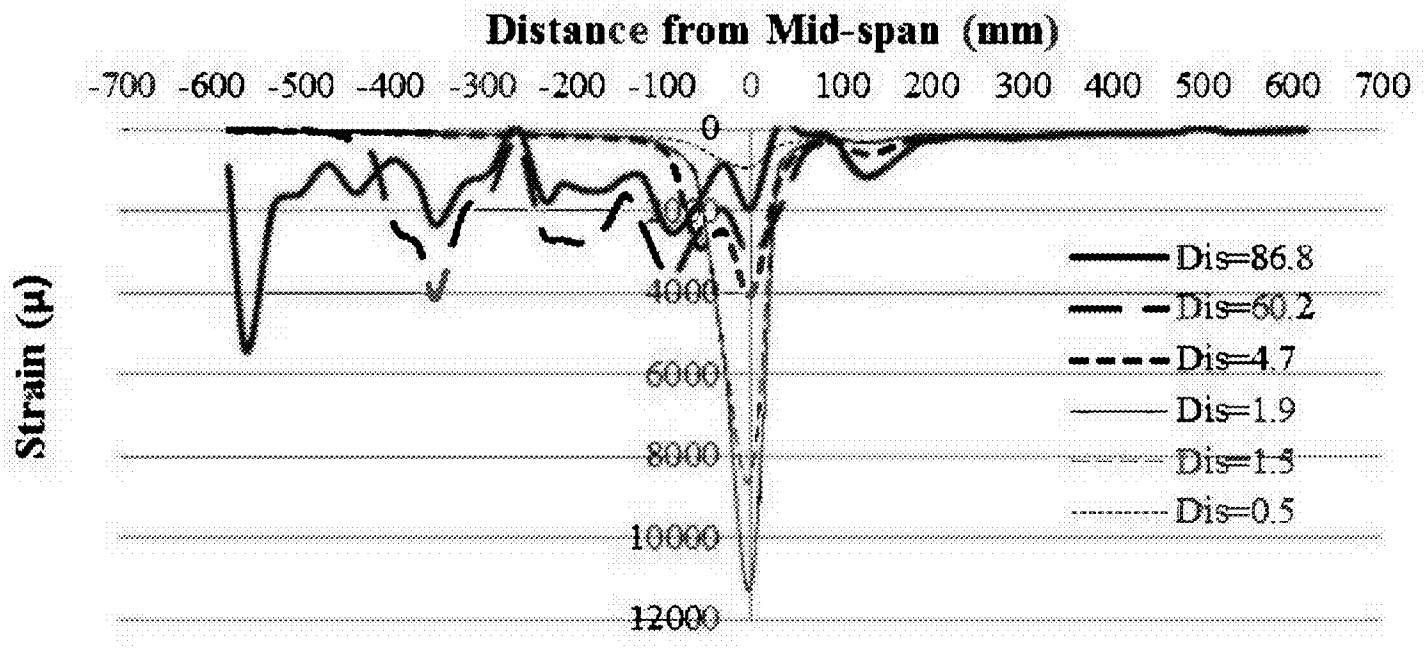
FIG. 7 to FIG. 9 are graphs illustrating strain distributions for test specimens SP5, SP6 and SP8, respectively.
Figure 8:
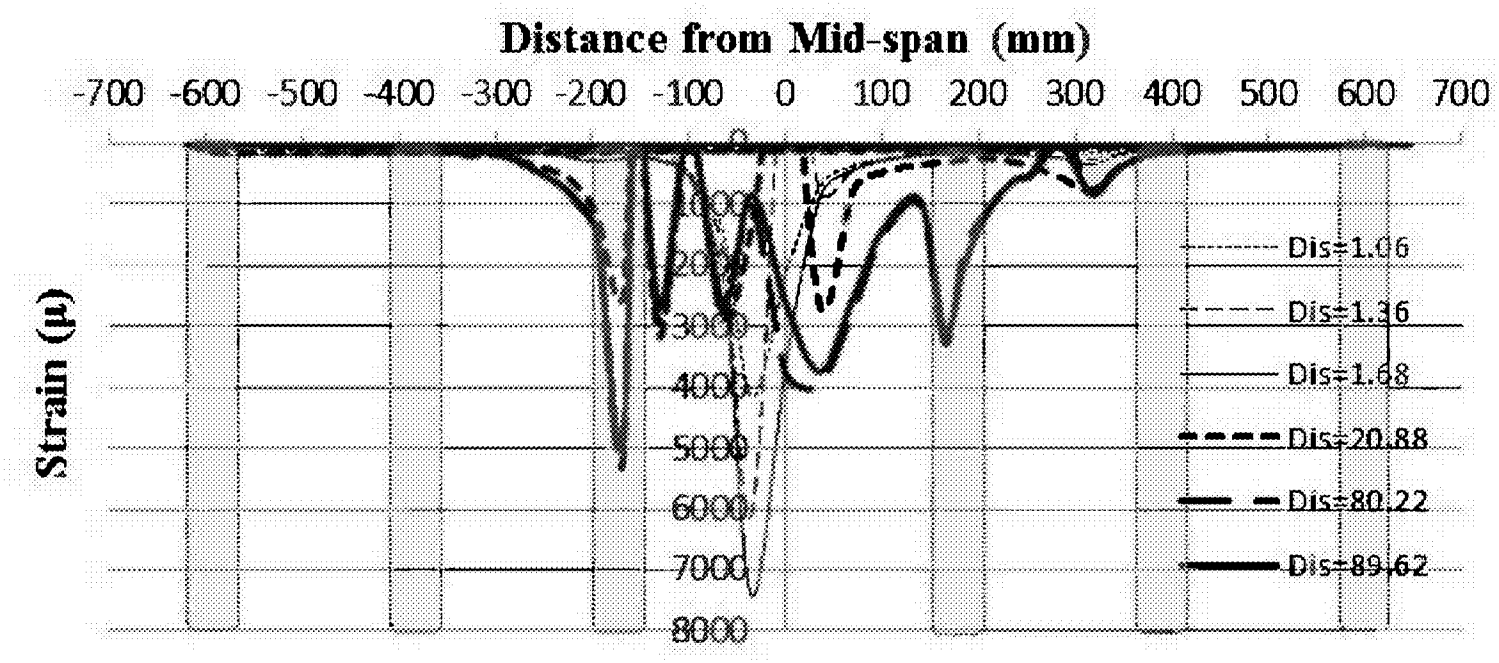

The effect of strain localization in preventing spread of debonding can be clearly seen in FIGS. 7 and 8. FIG. 7 shows the process of strain development in SP5 when displacement increases. It can be clearly seen that the strain at the mid-span increased very quickly in the beginning. After displacement reached 1.9 mm (load=10.6 kN), IC-debonding started to spread to the left hand side, and the steel sheet was completely debonded after displacement exceeded 86.8 mm (load=18 kN). FIG. 8 shows that straining of the steel sheet in SP6 was localized within the two SMAT zones adjacent to the mid-span of the beam. The shaded areas in FIG. 8 show positions of SMAT regions. IC-debonding apparently started to spread when displacement reached 1.68 mm (load=12.2 kN), after which the peak strain at the mid-span started declining and was extended to both sides. However, spreading of debonding was blocked by the two SMAT zones; it did not extend beyond these zones. Straining of the steel plate was confined within the strain localization areas until the steel sheet ruptured.

Group 3 Members (SP8 to SP12)

Figure 9:
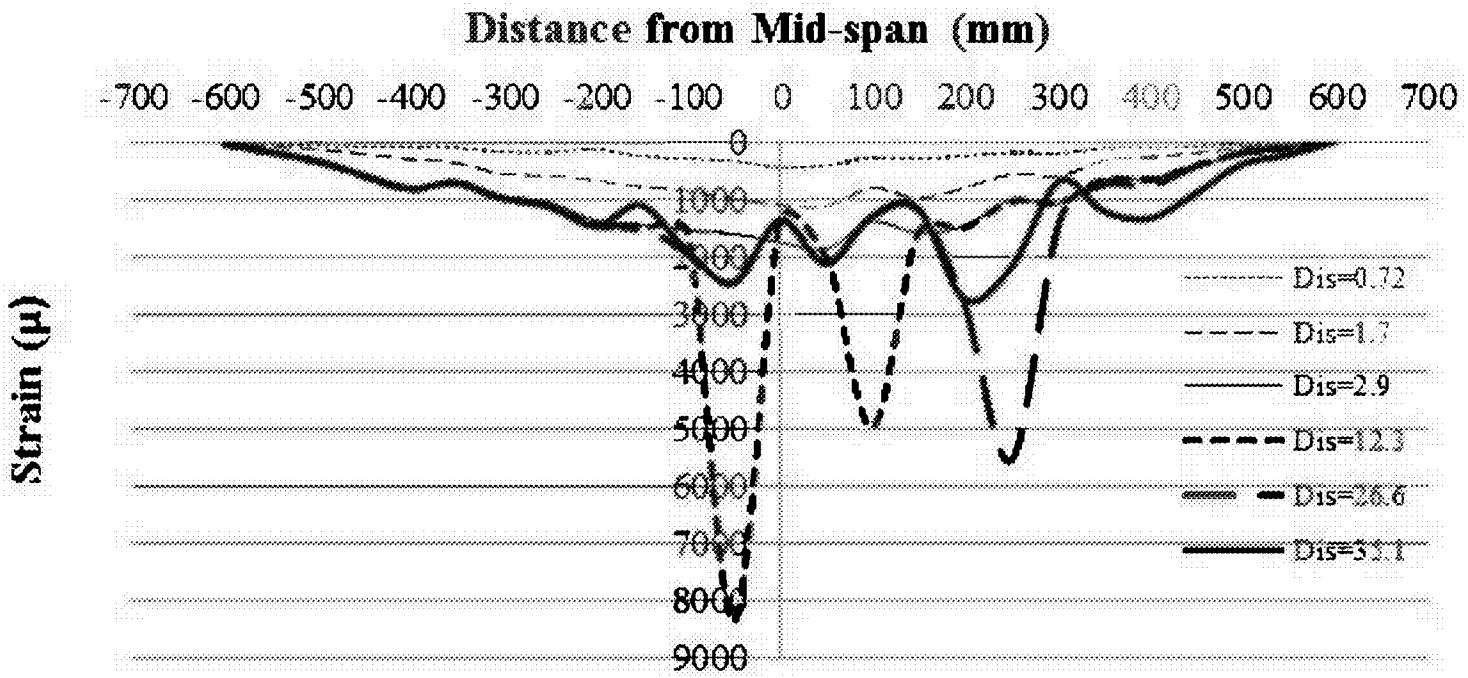
Figure 10A:
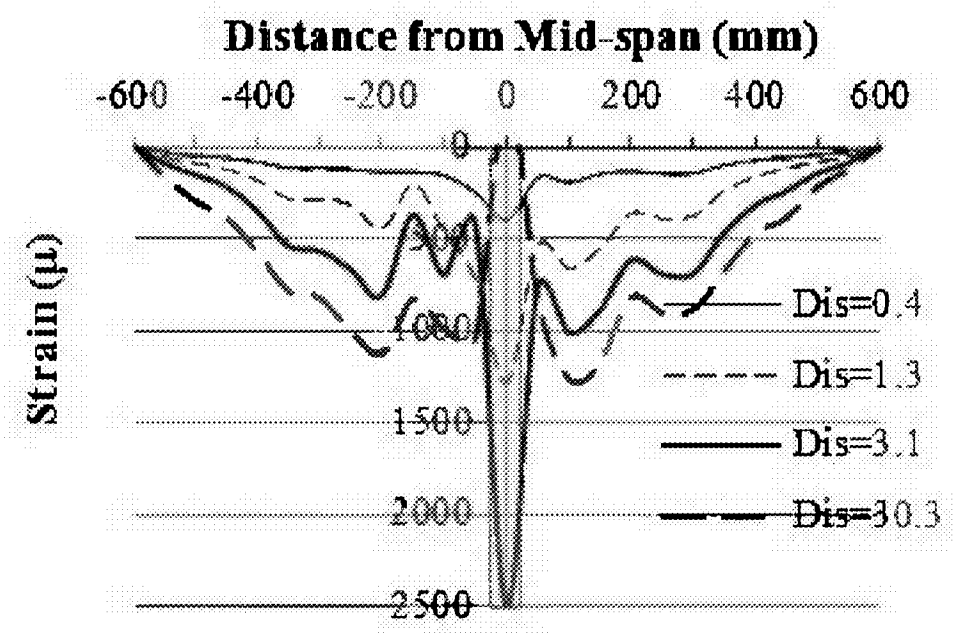
FIGS. 10A to 10D are graphs illustrating strain distributions with local weakening for test specimens SP9, SP10, SP11 and SP12, respectively.
Figure 10B:
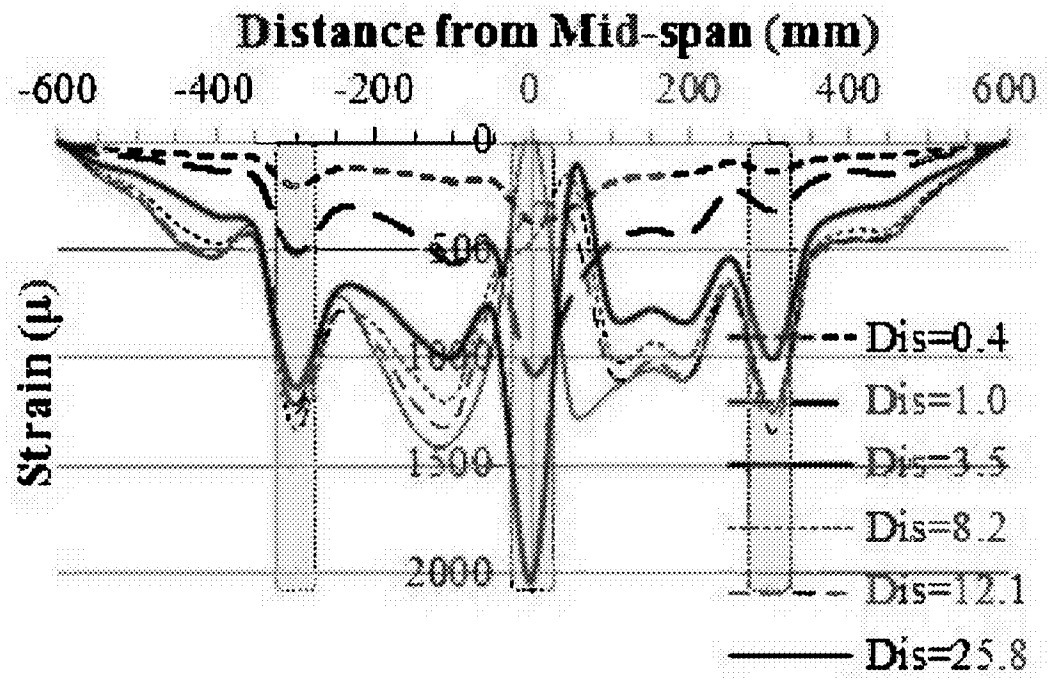
Figure 10C:
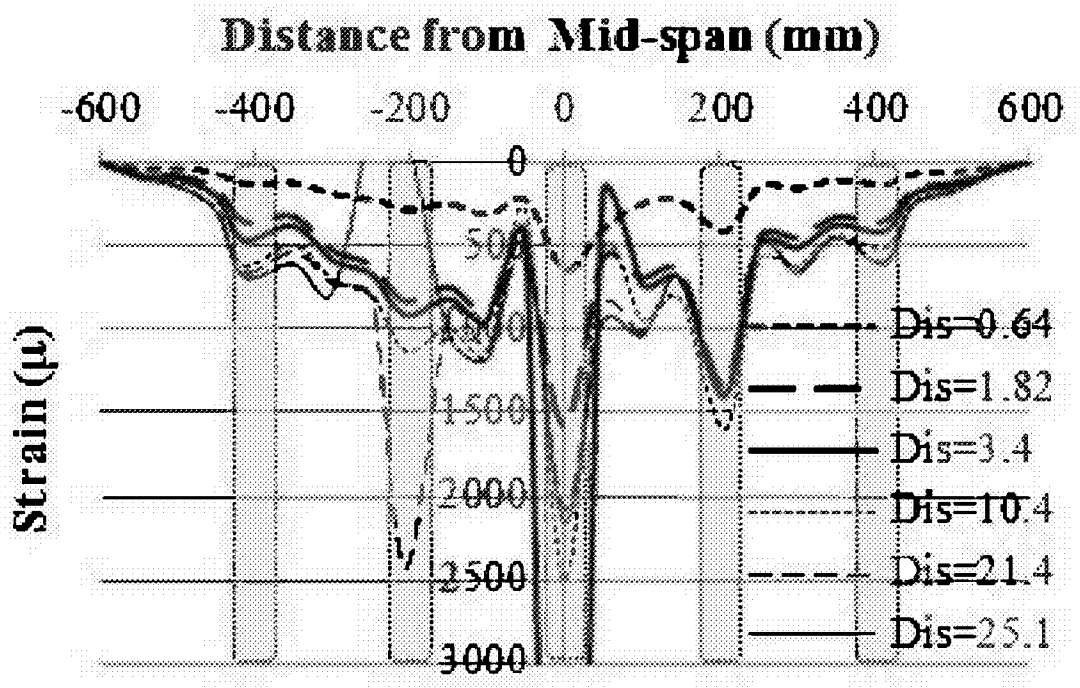
Figure 10D:
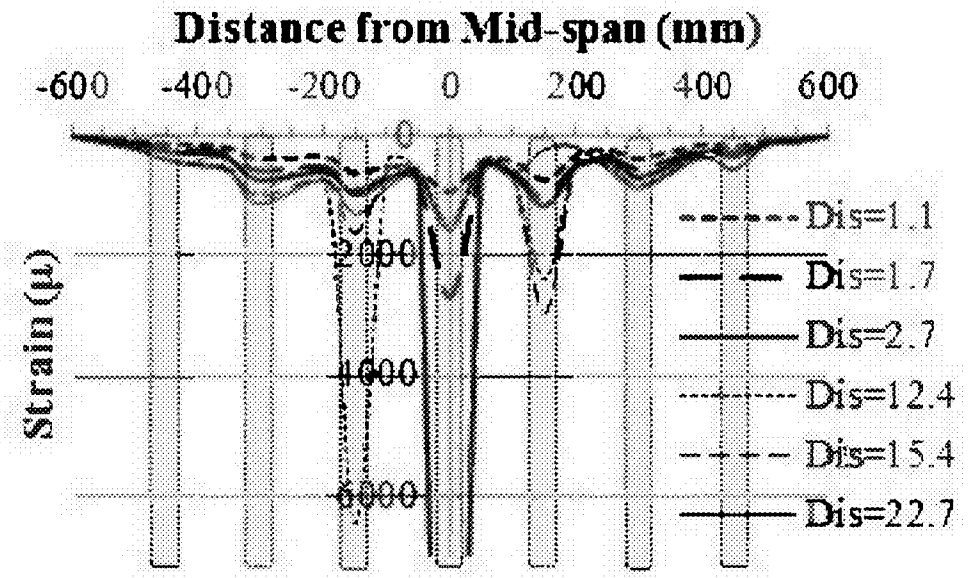

Group 3 was designed to further demonstrate the strain localization effect. Strain localization was realized by reducing the thickness (cross section area) of normal steel plate in certain parts (FIG. 4B) in this group. Strain distribution of the reference beam SP8 without local weakening is shown in FIG. 9. It can be seen from the figure that debonding started to shift towards right hand side after displacement of 12.3 mm and complete debonding occurred when displacement reached 38.5 mm. Strain distributions of other specimens in the group are shown in FIGS. 10A-10D. The shaded zones indicate positions of weakening in the steel plates. It can be clearly seen that large strains are localized in the weakened zones in all the four specimens. The strain localization relieved the strain demand in other areas and successfully avoided debonding of the steel plate, leading to the final rupture of the steel plate at the mid-span weakened zone.

It is to be noted that cracking was affected by the weakening, and the primary cracks were mainly located in the weakened regions. This phenomenon is logical as the weakened regions had much greater strain at the bottom face of the beams, which diverted the primary cracks to the strain localization zones.

From the above description and test results, it is to be understood that a new externally-bonded reinforcement system making use of strain localization can be used. With this scheme, straining demand of the externally-bonded reinforcement is diverted to relatively weaker zones (e.g. non/less-SMAT zones, thinner or narrower portions), leaving the bonded reinforcement in other zones in elastic and small strain condition, thereby avoiding complete debonding. Embodiments of the present invention can take at least two forms, one making using of SMAT/non(less)-SMAT zones while another making using of thicker portions-thinner portions (or wider portions-narrower portions). It is envisaged that embodiments making use of both SMAT/non(less)-SMAT zones and thicker portions-thinner portions may be used. In the context of embodiments making use of thicker portions-thinner portions to localize strain, the reinforcement attachments need not be metallic but may be other strong and ductile material.

The nanostructured reinforcement attachments described above can significantly increase the strength of thin steel sheets. Such strong steel sheets have advantages of strength of FRP and ductility of steel and, therefore, are more suitable for structural rehabilitation. Furthermore, local SMAT is an ideal way for strain localization. As the SMAT can easily increase yield strength of thin steel sheet, such treatment is sufficient to ensure that the treated zones stay under elastic stress (and hence small strain) even when untreated zones reach the ultimate strength and are subsequently stretched to rupture. The small strain condition at the treated and relatively stronger regions keeps the bond intact and blocks the spread of debonding to other regions.

It should be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. It is to be noted that certain features of the embodiments are illustrated by way of non-limiting examples. Also, a skilled person in the art will be aware of the prior art which is not explained in the above for brevity purpose.

The invention claimed is:

1. A construction structure comprising:

(a) a substrate made of a concrete material and providing an external surface; and (b) a reinforcement attachment made of a metallic material and defining an outwardly facing surface and an inwardly facing surface; and wherein said attachment is secured to said substrate with the inwardly facing surface bonded to the external surface of said substrate, said attachment having at least a first portion and a second portion, one or both of the surfaces of the attachment are pre-treated such that yield strength of the first portion(s) is higher than yield strength of the second portion(s) whereby when said construction structure is under loading the first portion(s) block(s) yielding or reduce(s) spreading of longitudinal strain sustained by said attachment along said attachment and yielding of the attachment is localized to the second portion(s) for avoiding or minimizing debonding of said reinforcement attachment from said substrate;

wherein the surfaces of said attachment are divided into a first zone and a second zone corresponding to the first portion(s) and the second portion(s) of said attachment, the first zone is pre-treated with surface nanocrystalization by using surface mechanical attrition treatment, and the second zone is either not pre-treated with nanocrystalization or pre-treated with less surface nanocrystallization using surface mechanical attrition treatment when compared with the first zone, whereby when said attachment is subject to longitudinal stress larger yield strain is confined between two adjacent first portions of said attachment for avoiding or minimizing debonding of said reinforcement attachment from said substrate.

2. A construction structure as claimed in claim 1, wherein the first portions and the second portions are alternatively arranged.

3. A construction structure as claimed in claim 1, wherein said attachment is made from a metallic material selected from the group including iron, titanium, copper aluminum alloy and steel.

4. A construction structure as claimed in claim 1, wherein said attachment is substantially planar or configured to wrap around said substrate.

5. A construction structure as claimed in claim 1, wherein said attachment is adhesively bonded to said substrate.

6. A construction structure as claimed in claim 1, wherein said attachment is secured to said substrate by further connection means selected from a group including mechanical fasteners, fiber anchorage fasteners and U-jacketing fasteners.

7. A construction structure as claimed in claim 1, wherein said structure is a beam.

8. A construction structure as claimed in claim 1, wherein said structure is a pillar.

* * * * *